US005382054A

United States Patent [19]

Bettiol

[11] Patent Number: 5,382,054

[45] Date of Patent: Jan. 17, 1995

[54] BOOK HOLDER

[76] Inventor: Michael Bettiol, 11 Ermina St., Hamilton, Ontario, Canada, L8W 3K1

[21] Appl. No.: 241,482

[22] Filed: May 12, 1994

[51] Int. Cl.[6] ..... B42D 9/00

[52] U.S. Cl. ..... 281/42; 281/45

[58] Field of Search ..... 281/42, 45; 24/67 R, 24/67.3, 67.7, 67.11

[56] References Cited

U.S. PATENT DOCUMENTS

| | | | |
|---|---|---|---|
| 4,474,383 | 10/1984 | Kikis | 281/42 X |
| 4,735,438 | 4/1988 | Demarest, Jr. | 281/42 |
| 4,982,685 | 1/1991 | Abe | 281/42 |
| 5,165,722 | 11/1992 | Wong | 281/42 |
| 5,246,251 | 9/1993 | Evans | 281/42 |

*Primary Examiner*—Willmon Fridie
*Attorney, Agent, or Firm*—McConnell and Fox

[57] ABSTRACT

A new book holder comprises two book receiving members and a connecting member which connects the two book receiving members together so that they can move toward and away from one another between two positions to hold respectively a small width book and a maximum width book. Each receiving member has a post member on its upper surface carrying a respective page engaging member pivoted thereon and spring biased to be movable between a position in which it contacts the surface of the respective book receiving member, and one in which it can contact the upper surface of the uppermost page of a book resting on the book receiving member. Preferably each page engaging member is of U-shape and is of springy wire material, so that it can flex to assist in urging the page engaging member into contact with the holder surface. The parts of the page engaging members in the posts may comprise torsion springs as part of the spring means. Each page engaging member preferably has its two side portions cranked to be concave toward the holder upper surface, so as to maintain engagement when the part of the book is thicker than the height of the pivot axis above the page receiving surface, and the end portion may be cranked along its length to provide downwardly extending corners that engage with the book uppermost page. Preferably the book receiving members are hollow and the connecting member slides within them. The book receiving members may be provided on their under surfaces with respective magnetic strips for attachment of the book holder to a ferrous metal surface, and the book receiving members and the connecting member may be provided on their upper surfaces with respective measuring scales.

20 Claims, 2 Drawing Sheets

BOOK HOLDER

FIELD OF THE INVENTION

This invention provides a new and improved book holder, namely a device for holding a bound book conveniently in opened condition at a desired page.

REVIEW OF THE PRIOR ART

A number of prior art devices have been proposed which attempt to solve the fundamental problem of providing a book holder that, while economical to manufacture, will be operative successfully with books of a wide range of sizes as to width and thickness, and particularly the latter.

For example, U.S. Pat. No. 4,474,383 discloses a holder comprising two elongate elements pivotally connected so that they can be nested together for storage, each element having at its end an open ended inwardly facing resilient loop. With the elongate elements in the opened position they engage the back of the book, the resilient loops engaging the fronts of the respective pages while permitting a page to be disengaged from one loop and engaged beneath the other loop.

U.S. Pat. No. 4,767,094 describes a book holder having a backing strip that extends behind the book, the backing strip having a non-skid surface to assist in maintaining the holder in place on the book and/or a table. The strip can be in two connecting parts for adjustment of its width. The ends of the strip are bent back toward each other at acute angles to form tabs that engage the front of the book and hold the pages in place.

U.S. Pat. No. 5,246,251 discloses a book holder of light durable material such as clear plastic comprising a base portion and U-shaped ends which overhang the pages to trap them between the overhang and the base portion. In one embodiment the base portion is in two parts which are mutually slidable to make the holder extensible in width.

All of the prior book holder constructions of which I am aware have the problem that they are very limited as to the range of thickness of the books with which they can used. Thus, if the book is very thick it may not be possible to mount the holder on the book at all, and if it is mounted it becomes difficult to disengage a page from one retainer and insert it beneath the other. On the other hand, if the book is thin the pages are not retained securely, and the holder tends to separate easily from the book as they are moved or even as held. This latter problem also exists with all thicknesses of books, i.e. even when they are not too thick, in that if the page to be examined is at or close to the beginning or the end of the book there are insufficient immediately adjacent pages for good retention contact between them and the respective page retainer.

SUMMARY OF THE INVENTION

It is a principal object of the invention to provide a new book holder.

It is a more specific object to provide a new book holder which is readily usable with books of a wide range of thicknesses, and which is operative successfully both at the beginning and the end of a book.

In accordance with the invention there is provided a book holder comprising:

two book receiving members each having a respective upper page receiving surface for the reception thereon of at least a portion of the respective outermost page of a book to be held by the holder;

a connecting member extending between the two book receiving members, connecting them together, and permitting them to move toward and away from one another between a minimum position in which the holder is adapted to hold a correspondingly small width book, and a maximum position in which they are spaced apart transversely a maximum amount and the holder is adapted to hold a correspondingly maximum width book;

each book receiving member comprising a post member extending vertically from its upper surface, a book in the holder resting on the book receiving member upper surfaces between the two post members;

each post member comprising two axially extending members having a common pivot axis extending parallel to the book side edges, the members projecting from the post member on opposite sides thereof, and a page engaging member extending from the axially extending members away from its respective post member toward the other post member, each page engaging member being movable between a minimum position in which it contacts the upper surface of the respective book receiving member, and a maximum position in which it can contact the upper surface of the uppermost page of a book resting on the book receiving member;

each page engaging member and the respective axially extending members comprising spring biasing means urging the page engaging member into contact with the book uppermost page for the entire range of positions of the page engaging member from the minimum position to the maximum position.

Preferably each page engaging member is of U-shape in plan with its side portions extending generally parallel to the book top and bottom edges, and its bottom portion connecting the side portion extending generally parallel to the book side edges. Such a page engaging member may be of resilient wire material and at least assists in urging the page engaging member toward its minimum position. Alternatively, or in addition, it may have a pair of top portions extending respectively from the two side portions, and constituting the said axially extending members of the respective post member, the top portions being anchored at their ends to the respective post member and comprising respective torsion springs which flex to at least assist in urging the page engaging member toward its minimum position.

Each U-shape page engaging member may have its two side portions cranked along their length so as to be of concave shape toward the respective book receiving member upper surface, thereby permitting maintenance of its engagement with the book uppermost page when the engaged part of the book is of greater thickness than the height of the pivot axis above the respective page receiving surface. It may also have its bottom connecting end portion cranked along its length so as to provide downwardly extending corners that engage with the book uppermost page to facilitate retention of the book on the book receiving member.

The axially extending members of each post member may comprise respective torsion springs which flex to at least assist in urging the page engaging member toward its minimum position.

The book receiving members may be hollow and provide respective longitudinal passages therein, the connecting member being mounted for sliding movement without substantial transverse play within the two book receiving members. Preferably, in the minimum position of the two book receiving members they contact one another and the connecting member is totally enclosed within them.

The book receiving members may be provided on their under surfaces with respective magnetic strips for attachment of the book holder to a ferrous metal surface, and the book receiving members and the connecting member may be provided on their upper surfaces with respective measuring scales.

DESCRIPTION OF THE DRAWINGS

Book holders which are particular preferred embodiments of the invention will now be described, by way of example, with reference to the accompanying diagrammatic drawings, wherein.

DESCRIPTION OF THE PREFERRED EMBODIMENTS

Figure 1:
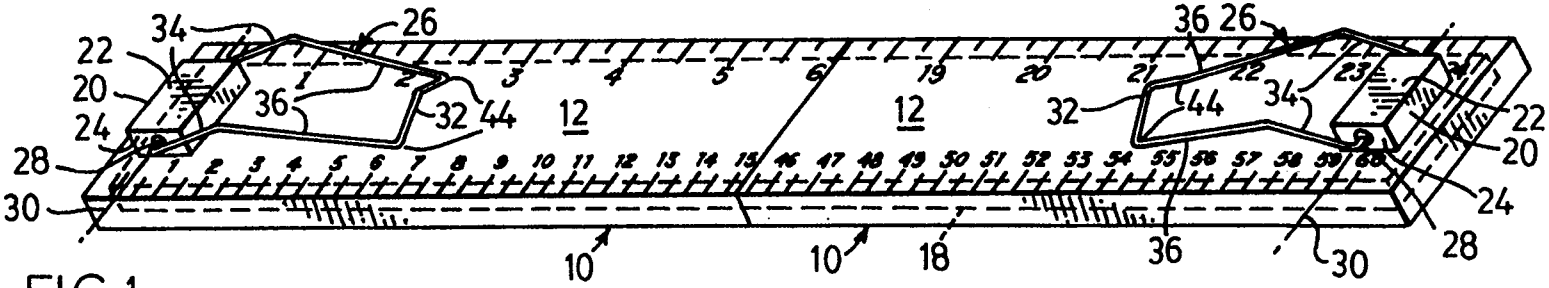
FIG. 1 is a perspective view from above and to one side showing a book holder in a minimum position in which it is stored, and in which it is adapted to receive a book of smallest width for which it is to be used.
Figure 2:
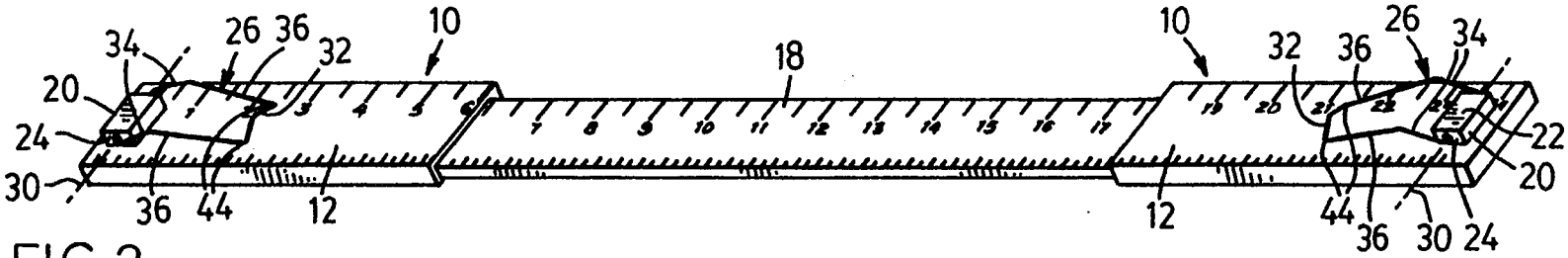
FIG. 2 is a perspective view similar to FIG. 1 and showing the book holder in a maximum position in which it is adapted to receive a book of greatest width for which it is to be used.

FIG. 1 illustrates a book holder comprising two book receiving members 10, each of which in this embodiment is rectangular in plan, side and end elevations, so that each of them has an elongated rectangular upper book receiving surface 12 upon which rests a book 14 (FIG. 3) held in the holder. The two members are hollow, having respective elongated passages 16 therein, and they are connected together by a connecting member 18 extending between them and freely slidable in the passages, so that the members 10 can move freely toward and away from one another. In this embodiment both the passages 16 and the connecting member are of corresponding rectangular cross sections, with the connecting member a close fit in the passages so that the sliding can take place without transverse play. This structure enables the holder to be closed to the minimum position shown in FIG. 1, which is its normal stored position, in which the connecting member is totally enclosed within the two book receiving members, and in which the holder is adapted to receive the smallest width book for which it is intended. It also enables the holder to be opened easily to the maximum extended position shown in FIG. 2, in which it is adapted to receive the largest width book for which it is intended.

Figure 3:
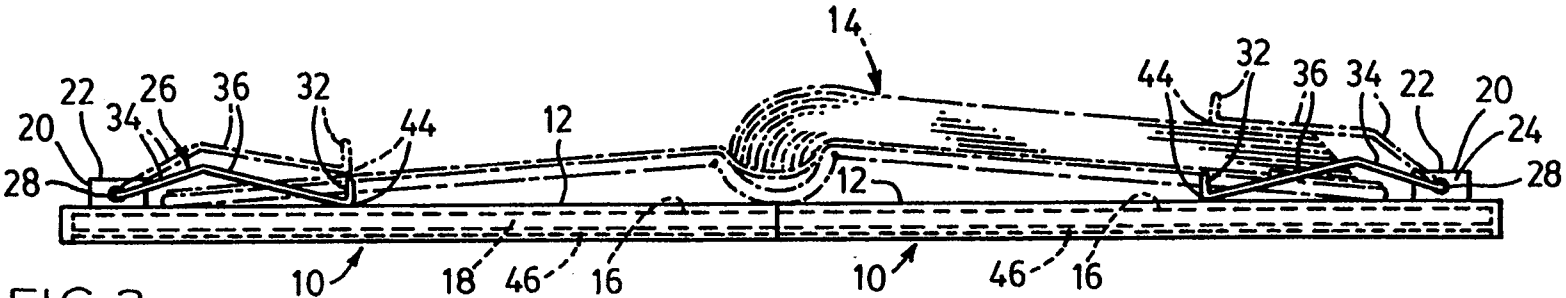
FIG. 3 is an end elevation from the bottom end to illustrate the manner in which a book is retained in the holder.

Each book receiving member 10 is provided close to its outer end with a vertically upwardly extending rigid post member 20 having an upper surface 22 and two side surfaces 24. The book placed in the holder rests on the book receiving surfaces 12 between these two posts, as illustrated by FIG. 3. Each post member supports a respective page engaging member, indicated generally by the reference 26, and has two axially extending members 28 projecting from its side surfaces 24, these members 28 establishing a common pivot axis 30 (FIGS. 4 and 5) that is spaced vertically above the respective book receiving surface 12 and extends parallel to the book side edges. In this embodiment each page engaging member is of U-shape in plan, comprising an end portion 32 and two side portions, each side portion comprising a lower part 34 having a respective junction with the end portion, and an upper part 36 connected to the respective axially extending member 28. Each page engaging member 26 and its associated axially extending members 28 comprise spring biasing means urging the page engaging member into contact with the respective uppermost page of the book, as will be described in more detail below.

Figure 4:
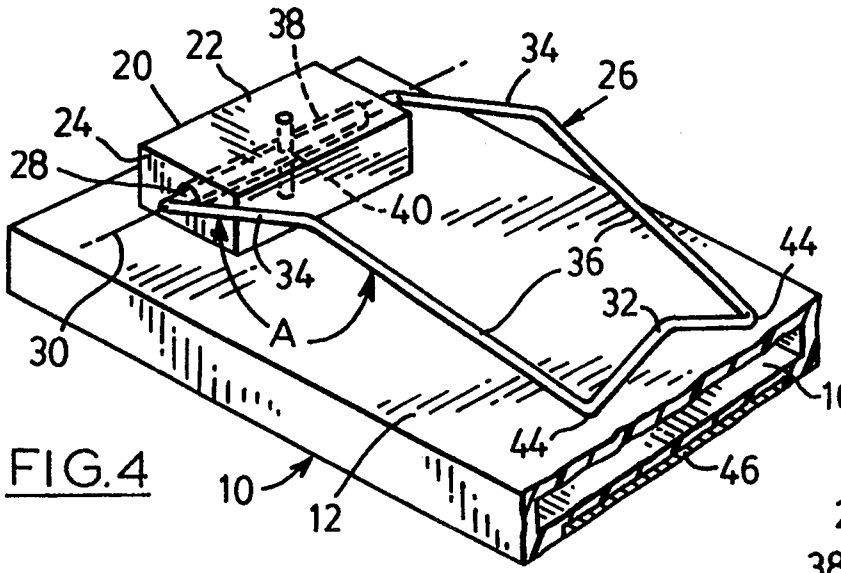
FIGS. 4 and 5 are perspective views to a larger scale of parts of two different book receiving members to illustrate different structures for page engaging members.

Referring now also to FIG. 4, in a first embodiment the two axially extending members 28 are provided by a thin metal strip which extends through a transversely extending bore 38 in the post member, the strip being fixed at its center point 40 so that the two members 28 comprise respective torsion springs which flex to urge their page engaging member 26 toward the minimum position in contact with the respective book receiving member upper surface, or into contact with the respective book uppermost page when a book is on the holder. With such a torsion spring means available the page engaging member can comprise a relatively rigid member, but preferably the U-shape member 26 comprises a loop of a resilient material, such as stiff springy wire, so that it also is able to perform as part of the spring biasing means. In the absence of a book the page engaging members are sufficiently spring biased by the cooperating spring members to extend downwards from the respective rigid post member and be in firm contact with the respective book receiving member upper surface, while they are able to pivot about the elevated axis 30 to an extent such that they will remain in contact with the respective book uppermost page, even if that page is only the book cover, or only a single thin paper sheet as with a soft cover book, for the entire range of positions of the page engaging member from the minimum to the maximum position.

An important advantage of this constant positive engagement of the book engaging members with the book is that the book holder is at all times well attached to the book, even if the assembly of book and holder is moved about, or picked up and carried about by the user. This positive attachment also ensures that with a book in the holder the three parts of the holder will remain together, even if owing to the inevitable manufacturing tolerances with a new holder, and/or subsequently due to constant use, the sliding fit between the book receiving members and the connecting member is not itself sufficiently tight to hold them together.

Figure 5:
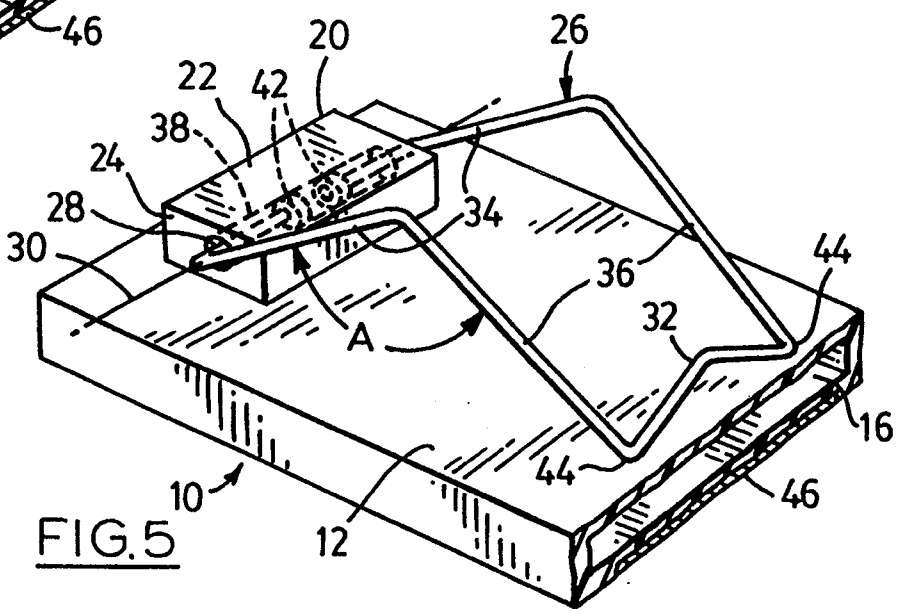

FIG. 5 shows another embodiment in which the two axially extending members 28 are also of stiff springy wire and are integral with the length of wire from which the U-shape member is formed to comprise top portions thereof, these top portions being anchored at their ends 42 within the respective post member so that they constitute torsion springs that cooperate with the remainder of the wire loop in providing the spring biasing means.

In these embodiments the page engaging members, as illustrated, are cranked along their length to permit maintenance of their engagement with the book uppermost page when the book is sufficiently thick that any part of the book resting on the book receiving member is of greater thickness than the height of the pivot axis above the book receiving surface. Thus, the side portion 34, 36 of each U-shape member 26 is cranked along its length, so as to be of concave shape toward the respective book receiving member upper surface, the two parts 34 and 36 being disposed at an angle A (FIGS. 4 and 5) to each other of less than 180 degrees. As is seen most clearly with the right hand book engaging member in FIG. 3, this enables the side portion lower part 34 to engage fully against the surface of the uppermost page, even though the book is relatively thick and the page is disposed a considerable height above the axis 30. The thickness of book for which the holder is intended can, if required, readily be adjusted for different models by simple modification of the book engaging members, without requiring any modification to the remainder of the holder, such modification comprising a change in the length of either or both of the parts 34 and 36, and/or a change in the angle A between them. For example, the embodiment of FIG. 5 has been arranged to accommodate a thicker book than that of FIG. 4 by increasing the length of the upper part 36, shortening the length of the lower part 34 in order to obtain a book engaging member of the same length, and decreasing the angle A.

Preferably the bottom connecting end portion 32 of each book engaging member is, as illustrated, cranked along its length so as to be concave toward the book receiving surface 12, thereby providing downwardly extending corners 44 that frictionally engage more positively than would a straight bar with the book uppermost page to facilitate retention of the book on the book receiving member. As added conveniences to the user the book receiving members and the connecting member are provided on their upper surfaces with respective cooperative measuring scales, and the book receiving members are provided on their under surfaces with respective magnetic strips 46 for attachment of the book holder to a ferrous metal surface. Although in the embodiments described and illustrated the passage 16 in which the connecting member slides is completely enclosed on all four sides, this is not necessarily the case in other embodiments. For example, the underside can be discontinuous, with a lengthwise central slot, so as to facilitate the manufacture and assembly; in such an embodiment the single magnetic strip will be replaced by two separate strips extending along the respective remaining narrow edges of the book receiving members. Other means of connecting the members, such as dovetail sliding joints of the kind used for example in slide rules, may instead be employed.

I claim:

1. A book holder comprising:

two book receiving members each having a respective upper page receiving surface for the reception thereon of at least a portion of the respective outermost page of a book to be held by the holder;

a connecting member extending between the two book receiving members, connecting them together, and permitting them to move toward and away from one another between a minimum position in which the holder is adapted to hold a correspondingly small width book, and a maximum position in which they are spaced apart transversely a maximum amount and the holder is adapted to hold a correspondingly maximum width book;

each book receiving member comprising a post member extending vertically from its upper surface, a book in the holder resting on the book receiving member upper surfaces between the two post members;

each post member comprising two axially extending members having a common pivot axis extending parallel to the book side edges, the members projecting from the post member on opposite sides thereof, and a page engaging member extending from the axially extending members away from its respective post member toward the other post member, each page engaging member being movable between a minimum position in which it contacts the upper surface of the respective book receiving member, and a maximum position in which it can contact the upper surface of the uppermost page of a book resting on the book receiving member;

each page engaging member and the respective axially extending members comprising spring biasing means urging the page engaging member into contact with the book uppermost page for the entire range of positions of the page engaging member from the minimum position to the maximum position.

2. A book holder as claimed in claim 1, wherein each page engaging member is of U-shape in plan with its side portions extending generally parallel to the book top and bottom edges, and its bottom portion connecting the side portion extending generally parallel to the book side edges.

3. A book holder as claimed in claim 2, wherein each U-shape page engaging member is of resilient wire material and at least, assists in urging the page engaging member toward its minimum position.

4. A book holder as claimed in claim 2, wherein each U-shape page engaging member has a pair of top portions extending respectively from the two side portions, and constituting the said axially extending members of the respective post member, the top portions being anchored at their ends to the respective post member and comprising respective torsion springs which flex to at least assist in urging the page engaging member toward its minimum position.

5. A book holder as claimed in claim 2, wherein each U-shape page engaging member has its two side portions cranked along their length so as to be of concave shape toward the respective book receiving member upper surface, thereby permitting maintenance of its engagement with the book uppermost page when the engaged part of the book is of greater thickness than the height of the pivot axis above the respective page receiving surface.

6. A book holder as claimed in claim 2, wherein each U-shape page engaging member has its bottom connecting end portion cranked along its length so as to provide downwardly extending corners that engage with the book uppermost page to facilitate retention of the book on the book receiving member.

7. A book holder as claimed in claim 2, wherein each U-shape page engaging member is of resilient wire material having a pair of top portions extending respectively from the two side portions, and constituting the said axially extending members of the respective post member, the top portions being anchored at their ends to the respective post member and comprising respective torsion springs which flex to at least assist in urging the page engaging member toward its minimum position.

8. A book holder as claimed in claim 2, wherein each U-shape page engaging member is of resilient wire material and an least assists in urging the page engaging member toward its minimum position, and wherein each member has its two side portions cranked along their length so as to be of concave shape toward the respective book receiving member upper surface, thereby permitting maintenance of its engagement with the book uppermost page when the engaged part of the book is of greater thickness than the height of the pivot axis above the respective page receiving surface.

9. A book holder as claimed in claim 2, wherein each U-shape page engaging member is of resilient wire material and at least assists in urging the page engaging member toward its minimum position, wherein each member has its two side portions cranked along their length so as to be of concave shape toward the respective book receiving member upper surface, thereby permitting maintenance of its engagement with the book uppermost page when the engaged part of the book is of greater thickness than the height of the pivot axis above the respective page receiving surface, and wherein each member has its bottom connecting end portion cranked along its length so as to provide downwardly extending corners that engage with the book uppermost page to facilitate retention of the book on the book receiving member.

10. A book holder as claimed in claim 1, wherein the axially extending members of each post member comprise respective torsion springs which flex to at least assist in urging the page engaging member toward its minimum position.

11. A book holder as claimed in claim 10, wherein each page engaging member is of U-shape in plan with its side portions extending generally parallel to the book top and bottom edges, and its bottom portion connecting the side portion extending generally parallel to the book side edges.

12. A book holder as claimed in claim 10, wherein each U-shape page engaging member is of resilient wire material and at least assists in urging the page engaging member toward its minimum position.

13. A book holder as claimed in claim 11, wherein each U-shape page engaging member has its two side portions cranked along their length so as to be of concave shape toward the respective book receiving member upper surface, thereby permitting maintenance of its engagement with the book uppermost page when the engaged part of the book is of greater thickness than the height of the pivot axis above the respective page receiving surface.

14. A book holder as claimed in claim 11, wherein each U-shape page engaging member has its bottom connecting end portion cranked along its length so as to provide downwardly extending corners that engage with the book uppermost page to facilitate retention of the book on the book receiving member.

15. A book holder as claimed in claim 11, wherein each U-shape page engaging member is of resilient wire material and at least assists in urging the page engaging member toward its minimum position, and wherein each member has its two side portions cranked along their length so as to be of concave shape toward the respective book receiving member upper surface, thereby permitting maintenance of its engagement with the book uppermost page when the engaged part of the book is of greater thickness than the height of the pivot axis above the respective page receiving surface.

16. A book holder as claimed in claim 11, wherein each U-shape page engaging member is of resilient wire material and at least assists in urging the page engaging member toward its minimum position, wherein each member has its two side portions cranked along their length so as to be of concave shape toward the respective book receiving member upper surface, thereby permitting maintenance of its engagement with the book uppermost page when the engaged part of the book is of greater thickness than the height of the pivot axis above the respective page receiving surface, and wherein each member has its bottom connecting end portion cranked along its length so as to provide downwardly extending corners that engage with the book uppermost page to facilitate retention of the book on the book receiving member.

17. A book holder as claimed in claim 1, wherein the book receiving members are hollow and provide respective longitudinal passages therein, and wherein the connecting member is mounted for sliding movement without substantial transverse play within the two book receiving members.

18. A book holder as claimed in claim 17, wherein in the minimum position of the two book receiving members they contact one another and the connecting member is totally enclosed within them.

19. A book holder as claimed in claim 1, wherein the book receiving members are provided on their under surfaces with respective magnetic strips for attachment of the book holder to a ferrous metal surface.

20. A book holder as claimed in claim 1, wherein the book receiving members and the connecting member are provided on their upper surfaces with respective measuring scales.

* * * * *